US008475751B2

(12) United States Patent
Jackson et al.

(10) Patent No.: US 8,475,751 B2
(45) Date of Patent: Jul. 2, 2013

(54) CATALYTIC SMOG REDUCTION

(75) Inventors: Gerald Peter Jackson, Lisle, IL (US); Jason Ryan Babcock, St. Charles, IL (US); Joseph Matthew Zlotnicki, Downers Drove, IL (US)

(73) Assignee: Green Light Industries, Inc., West Chicago, IL (US)

( * ) Notice: Subject to any disclaimer, the term of this patent is extended or adjusted under 35 U.S.C. 154(b) by 798 days.

(21) Appl. No.: 12/508,447

(22) Filed: Jul. 23, 2009

(65) Prior Publication Data

US 2010/0018191 A1 Jan. 28, 2010

Related U.S. Application Data

(60) Provisional application No. 61/083,007, filed on Jul. 23, 2008.

(51) Int. Cl.
*B01D 53/92* (2006.01)
*B01D 53/94* (2006.01)

(52) U.S. Cl.
USPC ..... 423/212; 422/119; 422/177

(58) Field of Classification Search
USPC ..... 422/119, 168, 177, 180, 211, 82.05, 422/82.11; 73/114.75; 356/43, 44; 374/121, 374/159, 161, 162; 60/299; 436/37; 181/212, 181/258; 423/212
See application file for complete search history.

(56) References Cited

U.S. PATENT DOCUMENTS

| | | | | |
|---|---|---|---|---|
| 3,766,536 | A * | 10/1973 | Hile | 340/592 |
| 4,201,446 | A * | 5/1980 | Geddes et al. | 385/125 |
| 4,288,159 | A * | 9/1981 | Newman | 374/161 |
| 5,338,903 | A * | 8/1994 | Winberg | 181/231 |
| 5,342,783 | A * | 8/1994 | Swars et al. | 436/37 |
| 6,315,076 | B1 * | 11/2001 | Bruck et al. | 181/258 |
| 7,384,609 | B2 * | 6/2008 | Zauner | 422/168 |

* cited by examiner

*Primary Examiner* — Jill Warden
*Assistant Examiner* — Joye L Woodard
(74) *Attorney, Agent, or Firm* — Peter K. Trzyna, Esq.

(57) ABSTRACT

A device, method of making, and method of using, illustratively wherein a container includes an inlet and an outlet; a catalytic converter intermediate in a path between the inlet and the outlet; at least one surface arranged to ensure at least a majority of gas received from the inlet traverses a first portion of the path from the inlet to the catalytic converter and communicates heat from the catalytic converter to the container; and an optical means arranged to transport visible light, emitted from the catalytic converter during reduction of the smog-generating chemical in the gas, to a location outside the container to indicate whether the catalytic converter is functioning properly.

37 Claims, 4 Drawing Sheets

Schematic illustration of one embodiment of this invention.

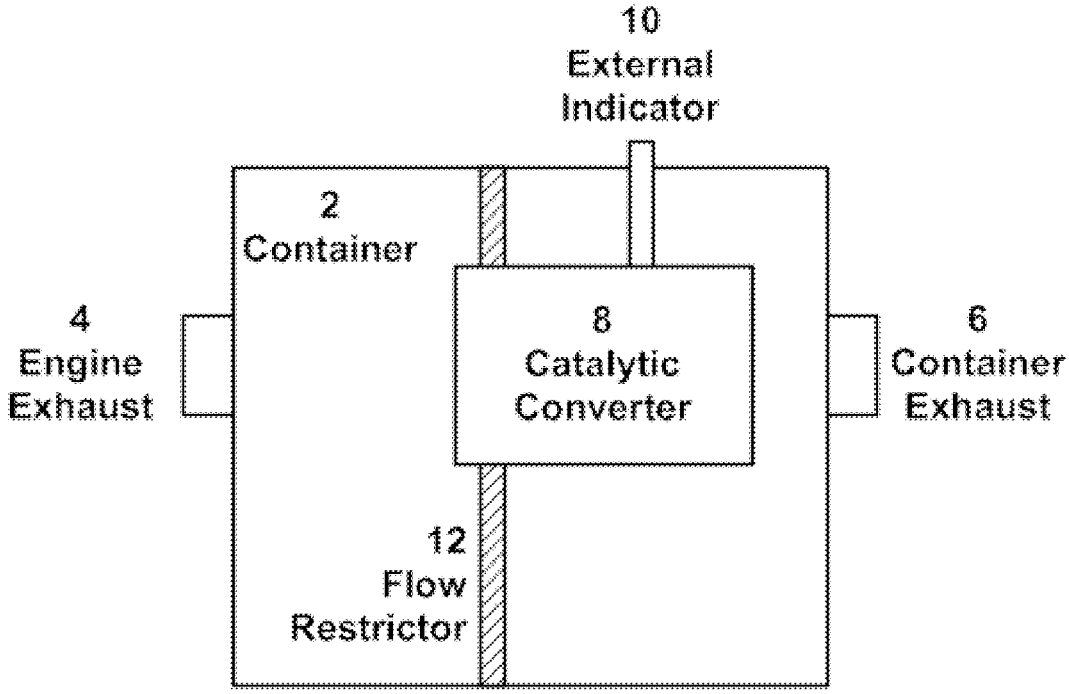
Figure 1: Schematic illustration of one embodiment of this invention.

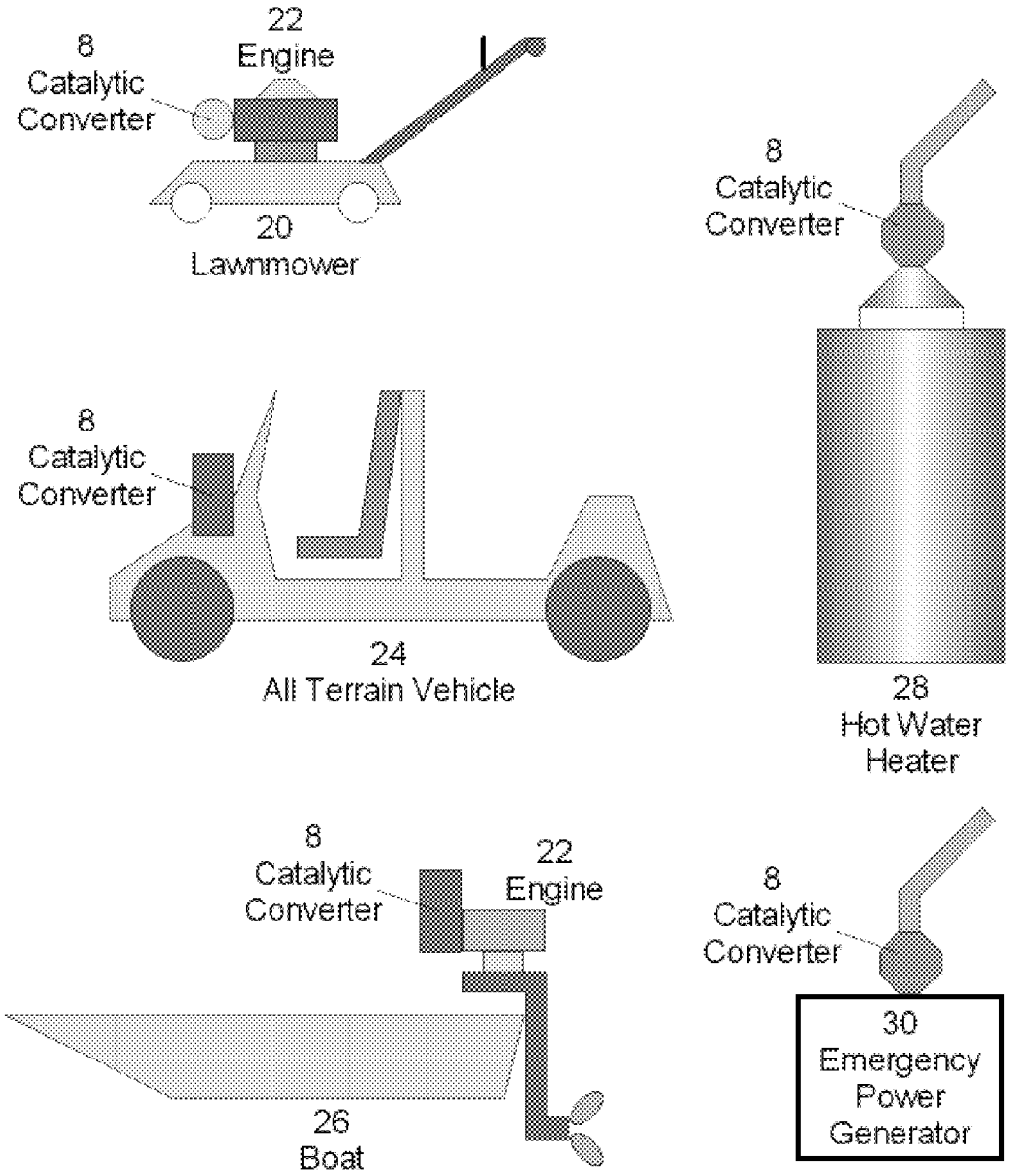
Figure 2: Schematic representations of catalytic converter applications.

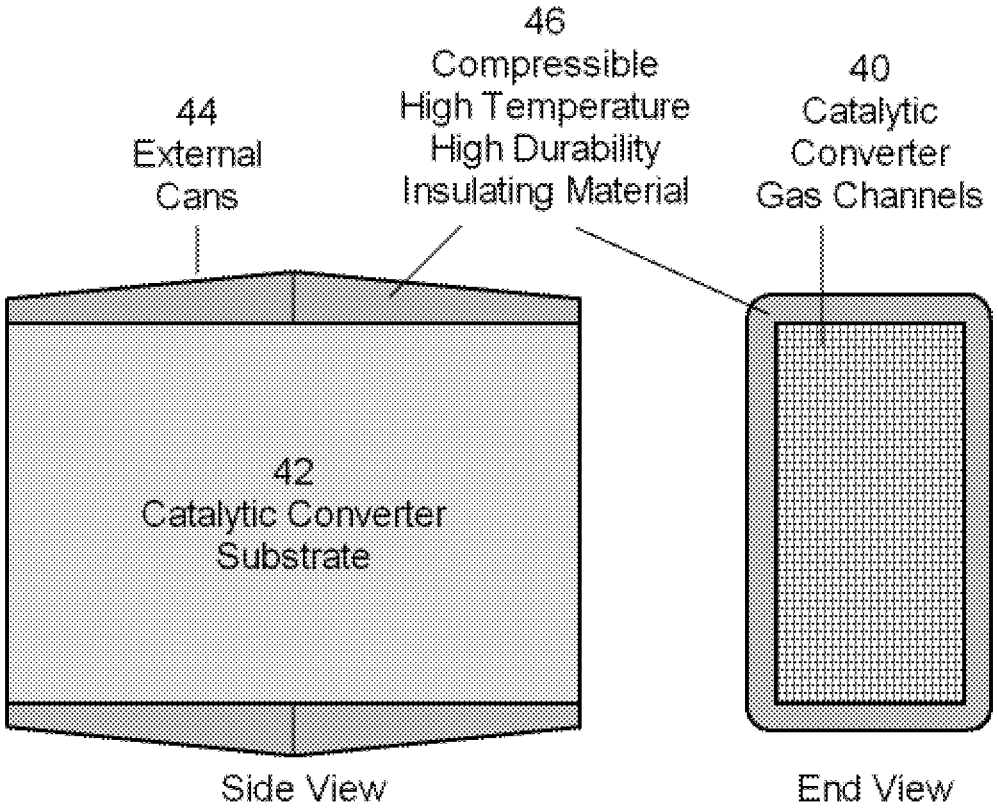
Figure 3: Schematic representation of the catalytic converter assembly.

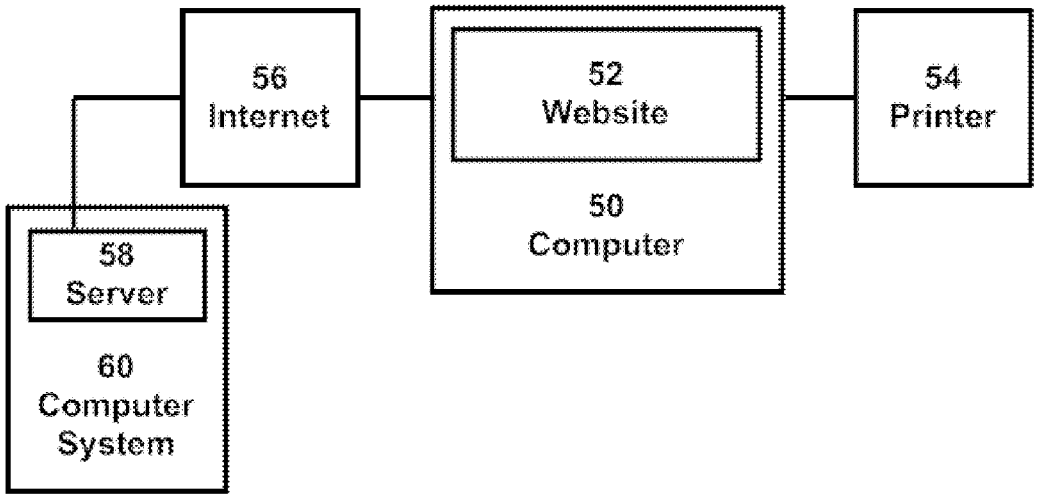
Figure 4: Embodiment of a computer system used to order a catalytic converter.

CATALYTIC SMOG REDUCTION

PRIORITY CLAIM

The present patent application claims benefit from, and incorporates by reference as if repeated herein, U.S. Patent Application Ser. No. 61/083,007 having the same title and filed Jul. 23, 2008 by the same inventors.

TECHNICAL FIELD

The technical field includes machine, manufacture, process, and product produced thereby, as well as necessary intermediates. In some cases, the technical field may pertain to smog reduction

BRIEF DESCRIPTION OF THE DRAWINGS

FIG. 1 is a schematic representation of a catalytic converter inside a container.

FIG. 2 is a set of schematic representations of catalytic converter applications.

FIG. 3 is a schematic representation of the catalytic converter assembly.

FIG. 4 is a schematic representation of one embodiment of a computer system used to order a catalytic converter.

MODES

Embodiments herein relate to reducing concentration of undesirable matter, such as compounds, in the exhaust from the combustion of a fuel with an oxidizer. Other embodiments relate to such combustion in an internal combustion engine. Yet other embodiments relate to such combustion in a generator of thermal energy. Further embodiments herein relate to undesirable matter, such as compounds that can cause smog. Additional embodiments herein relate to internal combustion engines smaller than those typically found in automobiles. Still further embodiments herein relate to the reduction of undesirable compounds using one or more catalysts. More embodiments herein relate to apparatus and methods for the reduction of undesirable compounds wherein a visual indicator that the catalytic process of undesirable compounds reduction is underway.

FIG. 1 is an illustration of a catalytic converter inside a container 2. In the case of some catalytic converter embodiments, such as those used in connection with boilers and other forms of reactors, a noise reduction function for the container may not be required. In a standard muffler, between the engine exhaust 4 and the container exhaust 6, one or more flow restrictors 12 can be used to provide varying path lengths of the highly compressed output pulse of exhaust gasses from an internal combustion engine. This dispersion in path lengths reduces the severity of the gas pulse, reducing the sound level it produces when coming into contact with the atmosphere.

In one embodiment, catalytic material applied to a substrate material (the combination typically referred to as a catalytic converter 8) is located inside a container 2 such that the catalytic converter 8 is constrained by one or more flow restrictor structures 12 in order to assure that a majority of the exhaust gas coming from the engine exhaust 4 is forced through the catalytic converter 8 before reaching the container exhaust 6.

In the case of automotive catalytic converters 8, oxygen sensors are employed in the exhaust system that are linked to an onboard computer. This computer varies the air-fuel mixture in order to periodically oxygenate the catalyst material and the trigger an engine warning light. The log file data from this computer is also read out and used in many states in lieu of actual exhaust testing during emission inspections.

A problem with this approach is that oxygen monitors are very expensive, often more expensive than the cost of a new lawnmower or other typical application. Therefore, an alternative method is desired to assure the consumer that the catalyst material is intact and that the catalytic converter 8 is functioning.

In response to this desire, an embodiment herein is to add an optically transparent or translucent light guide 10 between the catalytic converter 8 and the outside surface of the container 2. Because the catalyzed chemical reactions within a catalytic converter 8 are predominantly exothermic, the increased temperature of the exhaust gases causes the substrate material 42 within the catalytic converter 8 to heat to a point of emitting blackbody radiation. This blackbody radiation, which includes visible light, is coupled to the transparent or translucent light guide 10. This provides an external indicator 10 that the catalytic converter 8 is functioning.

Though this specification disclosure addresses all embodiments that respectively pertain to any device producing the chemical(s) removed, for the prophetic teaching purposes herein, consider particularly two representative kinds of combustion embodiments. Schematic representations can be found in FIG. 2. The first is the addition of catalytic converters 8 to lawnmowers 20. A similar application is recreation vehicles such as ATV's 24 and outboard motors for small boats 26. The second is the addition of catalytic converts to natural gas water heaters 28 and emergency power generators 30, even those based on the harvesting of blackbody radiation emitted from a surface heated with chemical energy, disclosed earlier in U.S. patent application Ser. No. 11/828,311 (U.S. Pub. No. 2008/0245407) by one of the current inventors, and incorporated herein by reference. In general, though, the technology offered herein can be applied to any engine, boiler, or reactor of size or power rating, especially ones less than those of an automobile.

Combined muffler/catalytic converter for lawnmowers without an external indicator and flow channeling for maintaining cooled muffler surfaces have been disclosed earlier in U.S. Pat. Nos. 4,867,270; 5,338,903 (expired); 5,548,955; 6,158,214; 6,315,076; 7,011,179; 7,156,202; and 7,281,606; which are all incorporated herein by reference.

A disadvantage of catalytic converters 8 is the increase in temperature of the gases at the muffler exhaust 6. The catalyzed chemical reactions enhanced by the catalytic material (s) are net exothermic. This means that the exhaust gas is heated by passage through the catalytic converter 8. It would seem that for a standard 6 hp lawnmower engine, the exhaust temperature can increase from roughly 700° C. to 950° C.

In embodiments herein, any combination of two concepts can be added, especially in the manner of an after-market catalytic converter. First, the exhaust flow from the engine before passage through the catalytic converter can be routed in order to produce a cooler muffler wall. Second, a small optical waveguide 10 can be added between the catalytic converter 8 surface (which glows with a yellow-orange color) and the outside wall of the muffler 2. This external glow provides assurance to the lawnmower operator that the converter is actually working. (Another indicator, such as a visual indicator, such as an optic fiber or other way to optically or otherwise communicate the functioning of the converter, is illustrative of other embodiments.) Third, the catalytic converter 8 is placed close enough to the muffler exhaust 6 to pull in oxygen from the atmosphere between gas bursts from the engine exhaust 4 when the exhaust gases cool down and create a short period of negative pressure within the muffler 2. The oxygenation of one or more catalytic materials in the catalytic converter 8 enables one or more of the reactions needed to reduce concentrations of undesirable matter. And as may be preferred in one application or another, the concept(s) can be configured to accommodate cowlings, gas tanks, and operator protection grills covering the muffler.

FIG. 3 contains a schematic representation of a catalytic converter substrate 42 supporting gas channels 40 supported by a compressible, high temperature, high durability, and insulating material 46 that is compressed transversely by one or more external cans 44. The external cans 44 are shaped such that the transverse dimensions of the cans with respect to the direction of gas flow is tapered. By pushing and attaching these external cans 44, a preloaded pressure is created within the insulating material 46 such that the substrate 42 is immobilized and all gases can pass through the gas channels 40.

On the materials side, an embodiment can be carried out by carving up an automotive catalytic converter to produce smaller catalytic converters. Because of the enormous quantities of automotive catalytic converters that are produced, the cost per unit is so low that considerable cost savings are realized during the fabrication of smaller catalytic converters by cutting up catalytic converters, and in some embodiments to harvest their catalysts bonded to their substrate material. This may be counter-intuitive to many practitioners in this field because of the short design lifetime of lawnmower engines (on the order to 150 hours) compared to that of an automobile engine (roughly 100,000 miles or 5000 hours).

Another embodiment comprises retrofitting configurations such that muffler/catalytic converter sizes and shapes fit onto existing lawnmowers, outboard boat motors, and other applications as possible with the fewest possible models. There are many different types of engine exhaust configurations, exhaust hole diameters, threaded hole placements, and dimensional constraints such as cowlings, gas tanks, and operator protection grills covering the muffler.

Yet another embodiment, schematically illustrated in FIG. 4, comprises a computer system 60 to support one or more embodiments herein. The computer system 60 can comprise a server 58 or equivalent structure, e.g., one or more processors programmed to receive input data and transform the input data into output data, and in some cases, the computer system can communicate with other computer systems linked by networking via the internet 56. The computer system 60 (e.g., server 58) processor can be programmed to provide a website 52 to support one or more of the embodiments discussed herein. The web site 52 can also handle muffler sales in accordance herewith, and to provide potential customers with any of: printable drawings, paper cut-outs, pictures, and in-depth descriptions that allow choosing the correct muffler style. A potential customer can use their computer 50 to view the website 52 and print out such items using the printer 54 attached to their computer. An option can also be provided for customers to send their mufflers to the manufacturer or retrofitter for handling in accordance herewith. The handling can thus be carried out from shipping to return receipt, indeed, between mowing cycles. Such computer-implemented embodiments open up after-market muffler sales.

As used herein, the term "computer" generally refers to hardware or hardware in combination with one or more program(s), such as can be implemented in software. Computers can be implemented as general-purpose computers, specialized devices, or a combination of general-purpose and specialized computing devices. Computing devices can be implemented electrically, optically, quantumly, biologically, and/or mechanically or in any combination of these technologies. A computer as used herein can be viewed as at least one computer having all functionality or as multiple computers with functionality separated to collectively cooperate to bring about the functionality. This includes single processor and multi-processor implementations of a computer. A processor can include any device that processes information or executes instructions. Computer logic flow and operations can be used in processing devices, including but not limited to: signal processors, data processors, microprocessors, and communication processors. Logic flow can be implemented in discrete circuits, combinational logic, ASICs, FPGAs, reconfigurable logic, programmed computers, or an equivalent.

Computer-readable media or medium, as used herein, includes any technology that includes a characteristic of memory. Memory technologies can be implemented using magnetic, optical, mechanical, or biological characteristics of materials. Common examples of memory are RAM, ROM, PROM, EPROM, FPGA, and floppy or hard disks. Communications medium or connection, as used herein, is any pathway or conduit in which information can be communicated or exchanged. The pathway or conduit can be wired, optical, fluidic, acoustic, wireless, or any combination of the foregoing.

The computer system can include one or more computers, which illustratively can be PC systems or server systems, and any combination of the foregoing. Depending on the implementation, computers can be adapted to communicate among themselves, or over a network such as the Internet. Programs, as used herein, are instructions that when executed by a processing device causes the processor to perform specified operations. Programs can be written in various languages, including but not limited to assembly, COBOL, FORTRAN, BASIC, C, C++, or Java. Languages can be object oriented like C++ and Java, for example. The programming language can be interpretive or compiled, or a combination of both. The programs are usually processed by a computing system having an operating system. An operating system can be processor specific, like an RTOS (real time operating system) used in cell phones, or commercial like OSX, UNIX, Windows, or LINUX. An operating system or program can be hardwired, firmware, reside in memory or be implemented in an FPGA or reconfigurable logic.

For example, a computer system can comprise a computer (e.g., an IBM, Hewlett Packard, MAC, or other personal computer) with one or more processors (e.g., an Intel or AMD series processor or the like), a memory (e.g., RAM, a hard drive, disk drive, etc.), one or more input devices (e.g., keyboard, mouse, modem, or the like), and one or more output devices (e.g., a modem, a Hewlett Packard printer, a Dell monitor, or other such output device). Note that the modem is representative of a computer-to-computer communication device that can operate as an input/output device. To provide other illustrative embodiments, the computer system can comprise at least one of a desktop computer, a telephonic device, a console, a laptop computer, and a mobile communication device. The mobile communication device can comprise at least one of a cellular telephone, laptop, a PDA, and an IPhone-type device. Communications between devices may be wired, for example cabled Ethernet based home or office network, wireless through IEEE 802.11a/b/g network cards or Bluetooth, or optical through an IR port. Networking between devices may be through WANs, LANs, Intranets, Internet or peer-to-peer arrangements, or in a combination of them. Networks may include, for example, gateways, routers, bridges, switches, front end and back end servers, IPS (Internet service providers), content provider servers, scanners, copiers, printers and user computing devices. Devices on the network may include interfaces that can be as simple, such as a keyboard with an LCD screen, or can be complex, such as a web interface. Web interfaces are presented in a web browser environment. Web browsers render XML or HTML containing pictures and links in a window on the desktop, for example like Windows XP. Firefox, Monzilla, Internet Explorer, and Safari are examples of well known web browsers.

Accordingly, there can be a computer apparatus, process, and/or product including advertising availability of aftermarket replacement mufflers, which can if desired also contain one or more catalytic converters the reduce smog producing chemicals; providing a website with information to guide potential customers to the correct model number; and permitting potential customers to communicate their existing mufflers for measurements aimed at either choosing or producing a muffler containing a catalytic converter, such that the consumer communications are received at the web site. The website information can, if desired, include printable pages which, when the specified cutting, pasting, taping, and/or folding take place, create a three-dimensional representation for comparison with an existing muffler to be replaced. Depending on the preferred embodiment, the website information can include one or more pictures and/or drawings that prompt or assist potential customers in a choice of a replacement muffler that contains a catalytic converter. In sum, appreciation is requested for the robust range of possibilities flowing from the core teaching herein. More broadly, however, the terms and expressions which have been employed herein are used as terms of teaching and not of limitation, and there is no intention, in the use of such terms and expressions, of excluding equivalents of the features shown and described, or portions thereof, it being recognized that various modifications are possible within the scope of the embodiments contemplated and suggested herein. Further, various embodiments are as described and suggested herein. Although the disclosure herein has been described with reference to specific embodiments, the disclosures are intended to be illustrative and are not intended to be limiting. Various modifications and applications may occur to those skilled in the art without departing from the true spirit and scope defined in the appended claims.

Thus, although only a few exemplary embodiments have been described in detail above, those skilled in the art will readily appreciate that many modifications are possible in the exemplary embodiments without materially departing from the novel teachings and advantages herein. Accordingly, all such modifications are intended to be included within the scope defined by claims. In the claims, means-plus-function claims are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment fastening wooden parts, a nail and a screw may be equivalent structures.

The invention claimed is:

1. Apparatus comprising:

a container comprising an outside surface, an inlet, and an outlet;

a catalytic converter, inside said container;

a surface located to ensure at least a majority of gas from the inlet is communicated into the catalytic converter, said surface shaped to prevent the outside surface from reaching a temperature that would cause said outside surface to visibly glow from heat generated during use of the catalytic converter to reduce concentration of a smog-generating chemical in the gas; and an optical means arranged to transport visible light, emitted from the catalytic converter during reduction of the smog-generating chemical in the gas, to a location outside the container so as to indicate whether the catalytic converter is functioning properly.

2. The apparatus of claim 1, wherein said inlet is attached to an exhaust port of a device configured for combustion of hydrocarbons.

3. The apparatus of claim 1, wherein said container is shaped to reduce noise from said container.

4. The apparatus of claim 1, wherein said surface is shaped to reduce noise from said container.

5. The apparatus of claim 1, wherein said smog-generating chemical includes at least one of an uncombusted hydrocarbon, nitrogen monoxide (NO), nitrogen dioxide (NO2), and carbon monoxide (CO).

6. The apparatus of claim 1, wherein said optical indicator is at least partially comprised of quartz, fused silica, borosilicate glass, or sapphire.

7. The apparatus of claim 1, further comprising a power generator, which harvests blackbody radiation emitted from a surface heated with chemical energy, operably associated with said catalytic converter.

8. The apparatus of claim 1, wherein said catalytic converter is at least partially comprised of one or more automotive catalytic converters.

9. The apparatus of claim 1, wherein said container is ordered via the Internet assisted by printed materials offered on a website to provide guidance as to at least one of size, shape, inlet location, outlet location, and inlet shape of the container.

10. The apparatus of claim 1, further comprising a lawn mower operably associated with the container.

11. The apparatus of claim 1, further comprising a boat operably associated with the container.

12. The apparatus of claim 1, further comprising an all terrain vehicle operably associated with the container.

13. The apparatus of claim 1, further comprising a hot water heater operably associated with the container.

14. A process of using, the process comprising:

receiving, from a device within which combustion has taken place, gaseous exhaust into a container having a catalytic converter therein;

directing said received gaseous exhaust into the container and through the catalytic converter;

catalytically reducing concentration of a smog-generating chemical in said gaseous exhaust;

indicating said reducing is functioning properly via an optical means arranged to transport visible light emitted from the catalytic converter during reduction of the smog-generating chemical in the gaseous, to a location outside the container.

15. A process of making, the process comprising:

forming a container comprising an outside surface, an inlet, and an outlet;

locating a catalytic converter inside said container;

positioning a surface to ensure at least a majority of gas from the inlet is communicated into the catalytic converter, including shaping the surface to prevent the outside surface from reaching a temperature that would cause said outside surface to visibly glow from heat transferred from operating the catalytic converter to reduce concentration of a smog-generating chemical in the gas; and orienting an optical means arranged to transport visible light, emitted from the catalytic converter during reduction of the smog-generating chemical in the gas to a location outside the container so as to indicate whether the catalytic converter is functioning properly.

16. The process of claim 15, further including making the catalytic converter by chopping up automotive catalytic converters.

17. The process of claim 16, wherein said catalytic converter is comprised of a substrate to which at least one catalyst is deposited; and further comprising packaging said substrate in a material, and compressing the material by sliding one or more tapered cans over ends of said substrate so that said substrate is secured.

18. The process of claim 17, further comprising a power generator, which harvests blackbody radiation emitted from a surface heated with chemical energy, operably associated with the container.

19. The process of claim 16, further comprising operably associating the container with a lawn mower.

20. The process of claim 15, further including providing on a website at least one of size, shape, inlet location, outlet location, and inlet shape corresponding to a plurality of devices including the container, and performing the steps of claim 11 responsive to an order placed at said web site for the container.

21. The process of claim 15, further comprising operably associating a boat with the container.

22. The process of claim 15, further comprising operably associating an all terrain vehicle with the container.

23. The process of claim 15, further comprising operably associating a hot water heater with the container.

24. Apparatus comprising:

a container comprising an inlet and an outlet;

a catalytic converter intermediate in a path between the inlet and the outlet;

at least one surface arranged to ensure at least a majority of gas received from the inlet traverses a first portion of the path from the inlet to the catalytic converter and communicates heat from the catalytic converter to the container; and an optical means arranged to transport visible light, emitted from the catalytic converter during reduction of a smog-generating chemical in the gas to a location outside the container so as to indicate whether the catalytic converter is functioning properly.

25. The apparatus of claim 24, wherein a second portion of the path is defined by the container, the catalytic converter, and the outlet, through which output from the catalytic converter is communicated to the outlet.

26. The apparatus of claim 24, wherein the first portion defines a muffler.

27. The apparatus of claim 24, wherein the first portion is arranged to reduces gas pulse.

28. The apparatus of claim 24, further including an internal combustion engine comprising an exhaust port in communication with the inlet.

29. The apparatus of claim 24, further including a lawn mower comprising an exhaust port in communication with the inlet.

30. The apparatus of claim 24, wherein said smog generating smog-generating chemical comprises at least one of an uncombusted hydrocarbon, nitrogen monoxide, nitrogen dioxide, and carbon monoxide.

31. The apparatus of claim 24, wherein said external optical indicator is at least partially comprised of quartz, fused silica, borosilicate glass, or sapphire.

32. The apparatus of claim 31, further comprising a lawn mower operably associated with the container.

33. The apparatus of claim 24, further comprising a power generator, which harvests blackbody radiation emitted from a surface heated with chemical energy, operably associated with the container.

34. The apparatus of claim 24, wherein said catalytic converter is comprised of a substrate to which at least one catalyst is deposited;

wherein said substrate is compressed by one or more tapered external cans disposed over ends of said substrate so to secure said substrate.

35. The apparatus of claim 24, further comprising a boat operably associated with the container.

36. The apparatus of claim 24, further comprising an all terrain vehicle operably associated with the container.

37. The apparatus of claim 24, further comprising a hot water heater operably associated with the container.

* * * * *

UNITED STATES PATENT AND TRADEMARK OFFICE

CERTIFICATE OF CORRECTION

PATENT NO. : 8,475,751 B2
APPLICATION NO. : 12/508447
DATED : July 2, 2013
INVENTOR(S) : Gerald Peter Jackson, Jason Ryan Babcock and Joseph Matthew Zlotnicki It is certified that error appears in the above-identified patent and that said Letters Patent is hereby corrected as shown below:

Title page, after item (75) and inventor Joseph Matthew Zlotnicki on page 1, delete "Drove" and insert --Grove--

IN THE CLAIMS:

Column 8, line 11, claim 27, delete "reduces gas pulse" and insert --reduce gas pulses--

Signed and Sealed this
Twenty-ninth Day of October, 2013

Teresa Stanek Rea
*Deputy Director of the United States Patent and Trademark Office*